United States Patent [19]

du Pont et al.

[11] Patent Number: 4,877,407

[45] Date of Patent: Oct. 31, 1989

[54] STACKABLE BLOCKS

[75] Inventors: Benjamin F. du Pont, Rockland, Del.; Carl J. Sukeforth, Lexington, Mass.

[73] Assignee: Benjamin F. Du Pont, Rockland, Del.

[21] Appl. No.: 201,396

[22] Filed: May 25, 1988

Related U.S. Application Data

[63] Continuation of Ser. No. 800,527, Nov. 21, 1985, abandoned.

[51] Int. Cl.[4] ..... A63F 9/00

[52] U.S. Cl. ..... 434/302; 434/403; 446/396; 273/I GF

[58] Field of Search ..... 434/300, 302, 403; 273/I GF, I GG, 153 S, 154; 446/117, 92, 396

[56] References Cited

U.S. PATENT DOCUMENTS

| | | | |
|---|---|---|---|
| 2,570,625 | 10/1951 | Zimmerman et al. | 434/403 |
| 3,400,932 | 9/1968 | Conrad | 446/396 |
| 3,461,574 | 8/1969 | Larson | 35/73 |
| 3,478,443 | 11/1969 | Imris | 35/19 |
| 3,567,221 | 3/1971 | Stults | 273/1 |
| 3,614,106 | 10/1971 | Morrison | 273/156 |
| 3,818,630 | 6/1974 | May | 446/396 |
| 3,863,918 | 2/1975 | Kramer | 273/1 R |
| 3,866,388 | 9/1975 | Lou | 35/69 |
| 4,005,868 | 2/1977 | Hein | 273/156 |
| 4,057,247 | 11/1977 | Morrison | 273/1 R |
| 4,293,128 | 10/1981 | Ebel | 273/1 GF |
| 4,522,393 | 6/1985 | Dunn | 273/1 GF |
| 4,522,403 | 6/1985 | Maciorowski | 273/154 |

OTHER PUBLICATIONS

Periodicubes Publication by Dyna-Slide Co., page 60, vol. 35, No. 5, May, 1968.

*Primary Examiner*—Carl D. Friedman
*Assistant Examiner*—Caroline D. Dennison
*Attorney, Agent, or Firm*—Fish & Richardson

[57] ABSTRACT

A set of stackable blocks in which there is a subset of blocks each having its center of mass offset from where the center of mass would be located if the block had a uniform mass distribution. In other aspects, the distribution of mass in one block can be shifted, and the blocks bear arbitrary symbols indicative of the characteristics of their mass distributions.

7 Claims, 5 Drawing Sheets

STACKABLE BLOCKS

This is a continuation of co-pending application Ser. No. 880,527 filed on Nov. 21, 1985 now abandoned.

BACKGROUND OF THE INVENTION

This invention relates to blocks for recreational and educational use.

Typical such blocks can be stacked in various configurations that are stable if enter of mass principles are not violated. The shapes of such blocks are sometimes made different to increase the challenge of stacking them.

SUMMARY OF THE INVENTION

One general feature of the invention is a set of blocks in which there is a subset of blocks each having its center of mass at a location that differs from the location which the center of mass of the block would have if the block had a uniform distribution of mass, and the blocks are stackable. Providing a different center of mass location enhances the challenge of stacking, and increases the educational value of, the blocks.

A second general feature of the invention is that a first block of a set includes means for shifting its distribution of mass. As a result, the effect of shifting the distribution of mass on the stacking behavior of the blocks can be observed.

Preferred embodiments of the invention include the following features. The subset encompasses the entire set of blocks. Each block has a frame (e.g., a parallelopiped box, in particular a cube) and a weight connected to the frame, the weight having a greater mass density than the frame; this makes the effects of relocating the center of mass more pronounced. The first block could alternatively be a sphere; then its motional properties are also interesting. The weight can be movable relative to the frame, providing a simple way to enable the mass distribution to be changed. The weight can be moved to a plurality of selectable distinct locations (e.g., by a track having a plurality of slots for receiving the weight, or by a threaded rod that cooperates with a threaded hole in the weight) relative to the frame, making the shifting of the mass more controllable. A plurality of weights can be removably attached to the frame, to permit the effects of different weights to be seen. There are a plurality of subsets of blocks, all of the blocks of each subset having the same shape and size and the same center of mass location, blocks in different subsets having the same size and shape and respectively different center of mass locations, whereby the range of stacking possibilities is increased.

A third general feature is a set of stackable blocks in which there is a subset of blocks each of which bears an arbitrary symbol indicative of characteristics of its mass. Thus the behavior of different blocks can be easily compared with the characteristics of their respective masses.

In preferred embodiments having the third feature, each symbol has an arbitrary visual feature indicative of the mass, or of the location of the center of mass, or of the fixed or movable condition of the mass of its block.

In other general features, the invention is a block of the kind recited for each of the three general features, for use as one of a set of stackable blocks.

Other advantages and features of the invention will become apparent from the following description of the preferred embodiments, and from the claims.

DESCRIPTION OF THE PREFERRED EMBODIMENT

We first briefly describe the drawings.

Drawings

FIGS. 3, 4, 5, and 8 are side views of stacks of blocks.

Figure 6:
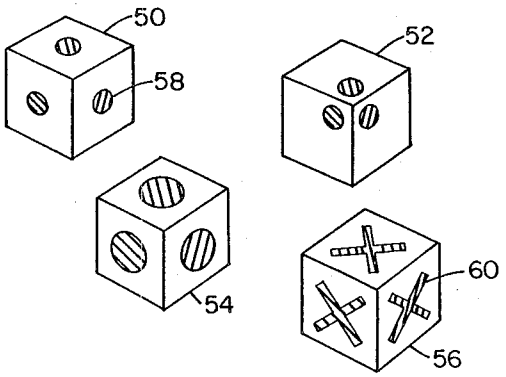
Figure 7:
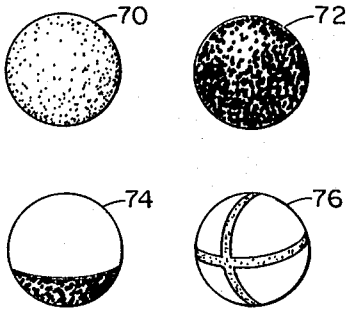

FIGS. 6, 7 are isometric views of types of cubic and spherical blocks.

Figure 9:
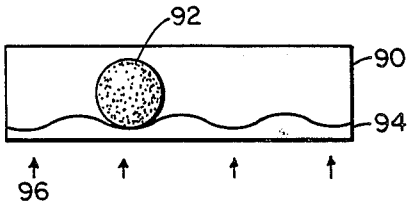
Figure 10:
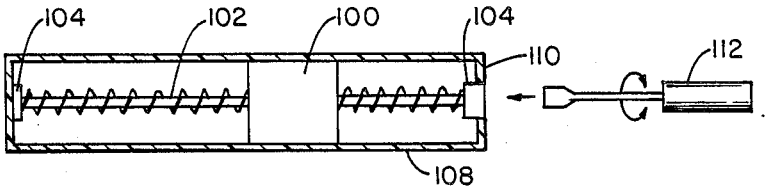

FIGS. 9, 10 are schematic side views of blocks with movable weights.

Figure 11:
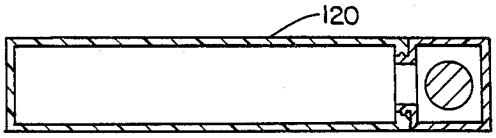

FIG. 11 is a sectional schematic side view of a block with a detachable weight.

STRUCTURE AND OPERATION

Figure 1:
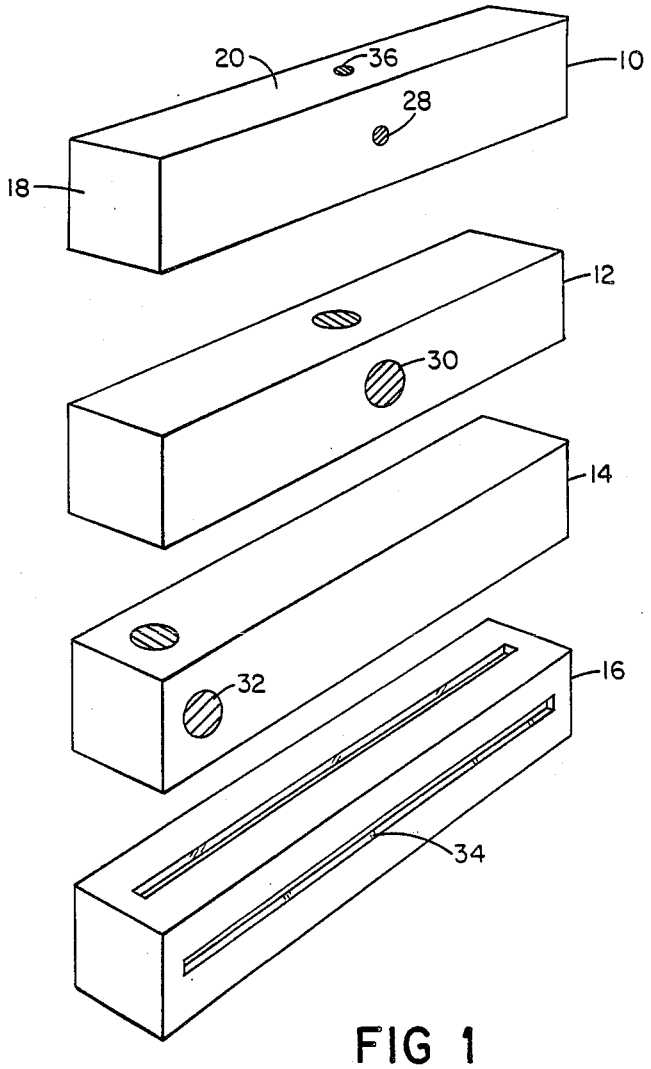
FIG. 1 is an isometric view of four types of rectangular blocks.

Referring to FIG. 1, a group of stackable toy blocks includes blocks of four different types 10, 12, 14, 16. All four types are identical in shape and size, each being a parallelopiped having an external surface made up of two square end panels 18 and four rectangular side panels 20.

Figure 2:
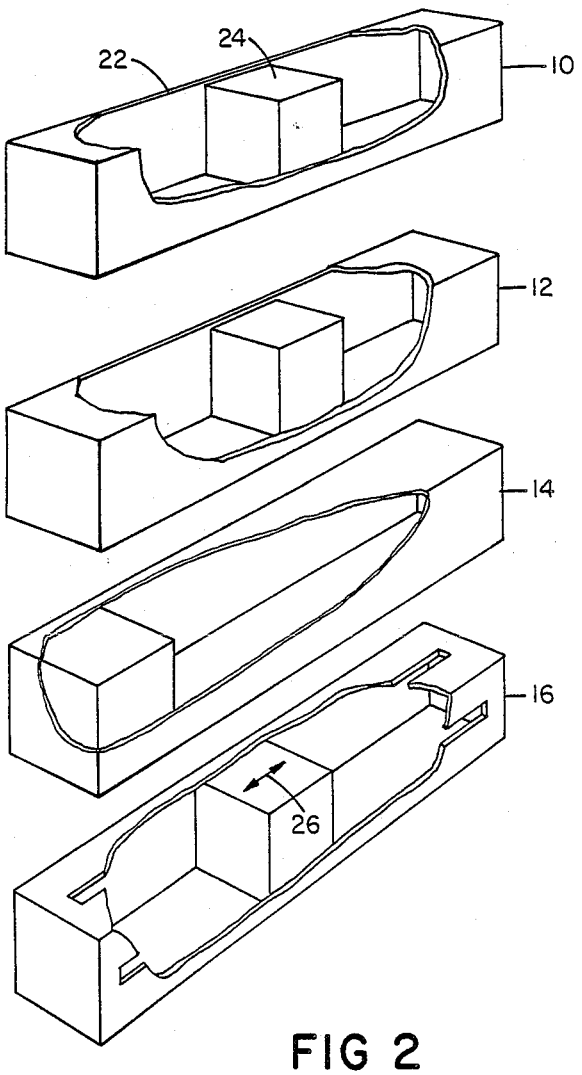
FIG. 2 is an isometric view, partially cutaway, of the four types of blocks of FIG. 1.

Referring to FIG. 2, each block is formed of a lightweight plastic shell 22 whose external surface bears a high friction soft coating. The shell of each block holds a weight 24. The four types of blocks differ in the location of the weight, the mass of the weight, and whether or not the weight is fixed or free to move. In types 14, 16, the weight has the effect of shifting the center of mass of the blocks relative to a block that had no weight. In types 10, 12 the weight alters the inertial characteristics of the block. In type 10 blocks, the weight has an arbitrarily chosen mass of one unit and is glued in a fixed location midway between the end panels of the block. In type 12, the weight has a mass of three units and also has a fixed location midway between the end panels. In type 14, the weight (three units mass) is fixed at one end. In type 16, the weight (three units mass) is free to move back and forth within the shell as suggested by arrows 26.

Referring again to FIG. 1, each type of block bears a mark 28, 30, 32, 34, to indicate the mass, location, and mobility of the weight that it contains, according to the following code. A mark in the shape of a dot represents a weight fixed in the location indicated by the position of the dot. The size of the dot represents the relative mass of the weight. For example, dot 32 indicates a larger mass fixed at one end of a block in type 14. A line (e.g., 34) represents a weight that is movable along a direction indicated by the orientation of the line. The marks are duplicated on two faces of a block, e.g., dot 36.

A set of stackable blocks includes multiple blocks of each type. Because of the uneven distribution of mass established by the weight 24 within each block, the blocks can be stacked in ways that would not be possible with conventional blocks. Clues about how the blocks can be stacked and why they remain stacked are given by the markings. Because the inserted weight is relatively much heavier than the shell of each block, the external mark is a reasonably good indication of the location of the center of mass of the block. As a result, the marks aid in learning the principles that (1) a block will rest stably on a surface only if its center of mass lies vertically above a base area which is supported by the surface, and (2) a stack of blocks will stand stably on a surface only if its overall center of mass lies above the base area which is supported by the surface.

Figure 5:
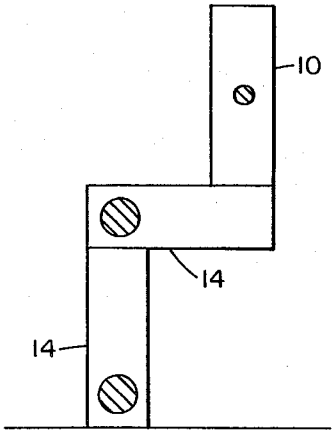
Figure 4:
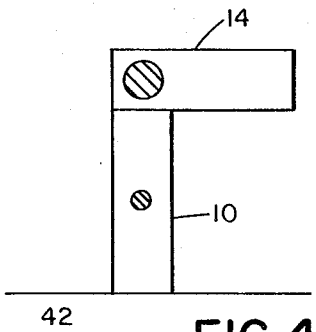
Figure 3:
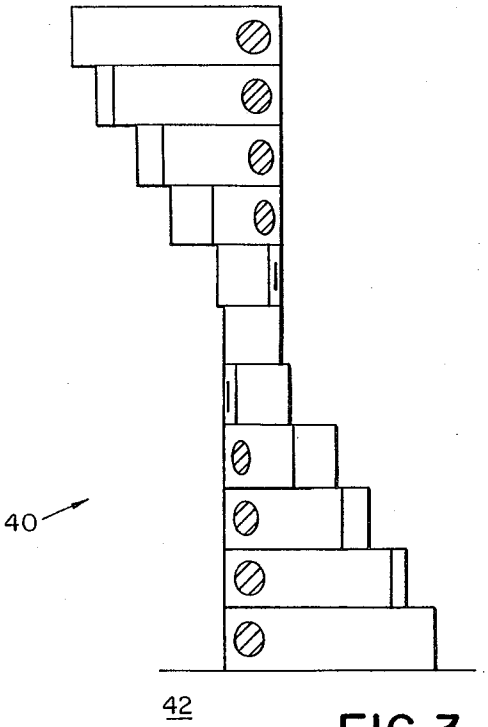

For example, referring to FIG. 3, a set of eleven type 14 blocks can be stacked in a spiral column 40 on a surface 42 by placing the marks 32 (and hence the centers of gravity) vertically above one another. Other stacking arrangements are shown in FIGS. 4, 5. (The stack of FIG. 5 is possible only if the weights of the blocks are made sufficiently heavy relative to their shells.)

Other Embodiments

Other embodiments are within the following claims.

For example, referring to FIG. 6, other shapes of blocks may be used, such as cubes of types 50, 52, 54, 56 each of which contains a smaller cubic weight within its shell, the location, mass, and mobility of the weight again being indicated by the size and position of dots (e.g., 58) or crossed lines (e.g., 60).

Referring to FIG. 7, the blocks could also be spherical types 70, 72, 74, 76 each containing a smaller weight. Types 70, 72 have markings comprising light and dark shading to indicate that they have their weights mounted in the center and that the weights are respectively lighter and heavier. Type 74 is marked with dark shading at one sector to indicate that a heavier weight is located there.

Figure 8:
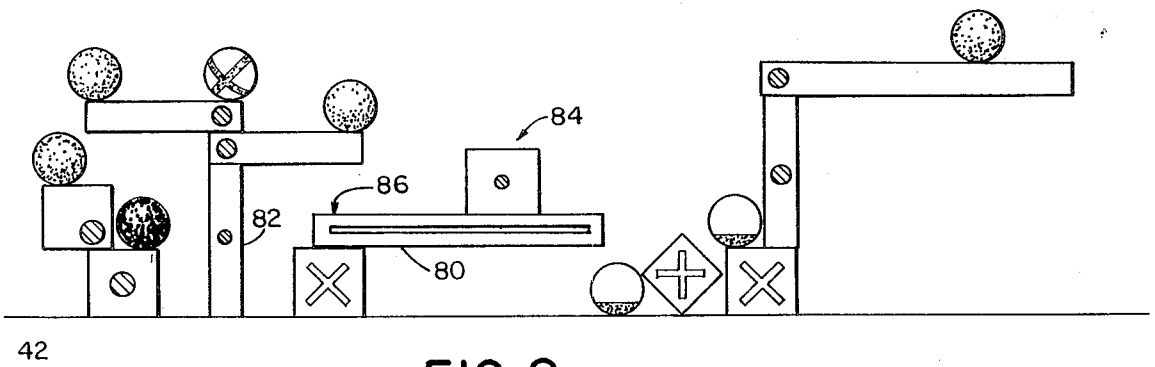

FIG. 8 shows other examples of ways of stacking the blocks. Some rectangular blocks 80 can be made twice as long as other blocks 82. To build stack 84, the weight in block 80 must first be moved to the end 86 by holding block 80 with end 86 down to allow the weight to slide into position at end 86.

The blocks can include types having other proportions, sizes, and external shapes. More than two different masses can be used in different types of blocks. The weights can have other fixed locations. Other techniques can be used for imparting an uneven mass distribution. A different code for marking the blocks can be applied, for example color-coding. Instead of external markings, the blocks can be formed of clear outer shells and the weights can be color-coded according to mass. Then the masks and positions of the weights can be observed directly.

Referring to FIG. 9, in another technique for permitting the location of the weight to be controlled, the block 90 has a clear shell, and the weight is a sphere 92 that rests on an undulating track 94. By bouncing and tilting block 90, sphere 92 can be moved to any one of four positions 96 along the length of block 90. Alternatively, block 90 could be twice as long as shown and contain two spheres that could be positioned at different locations on a similar track.

Referring to FIG. 10, weight 100 could have a threaded hole (not shown) for mounting on a threaded rod 102, journaled in a pair of bearings 104, 106 at opposite ends of a block 108. Rod 102 extends through bearing 106 and has a slotted end that is accessible but recessed in the end 110 of block 108. A screwdriver or other appropriate tool 112 can then be inserted into the slotted end of rod 102 and rotated to move weight 100 to any desired position along the length of block 100.

Referring to FIG. 11, a block 120 could also have a removable weight 122 that is held in place on the end of block 120 by an appropriate locking mechanism but is easily removed or replaced by other weights.

The blocks can be used within a liquid medium, e.g., a tank of water, as well as air.

We claim:

1. A set of blocks that are stackable and restackable in different configurations, each block arranged to rest stably only when its center of mass lies vertically above a part of the block which is supported, at least some blocks each having a frame and a weight within the frame arranged so that the center of mass of the block is at a location that differs from the location the center of mass would have if the block had a uniform distribution of mass, the weight in at least one of the blocks being significantly heavier than the frame, different blocks having different masses, at least some of the blocks each bearing a mark which symbolizes the relative magnitude of the weight and the location of the weight and hence the location of the center of mass of the block.

2. A set of blocks that are stackable and restackable in different configurations, each block arranged to rest stably only when its center of mass lies vertically above a part of the block which is supported, at least some blocks each having a frame and a weight within the frame, the blocks including at least three different types of blocks, a first type of block being relatively light in weight and having its center of mass in the same location as the center of mass of a block having a uniform distribution of mass, a second type of block being relatively heavy in weight and having its center of mass offset substantially from the location of the center of mass of a block having a uniform distribution of mass, a third type of block being relatively heavy in weight and having its center of mass in the same location as the center of mass of a block having a uniform distribution of mass, each block having a mark which indicates the relative weight of the block and the location of its center of mass.

3. The set of claim 1 or 2 wherein said frame comprises a parallelopiped box.

4. The set of claim 1 or 2 wherein said frame comprises a cube.

5. The set of claim 1 or 2 comprising a plurality of subsets of said blocks, all of said blocks in each said subset having the same shape and size and the same center of mass location, blocks of different said subsets having respectively different center of mass locations.

6. The set of claim 5 wherein all of said blocks of all said subsets have the same size and shape.

7. The set of claims 1 or 2, wherein said weight has a different mass density from said frame.

* * * * *